US010930199B2

(12) United States Patent
Ahn

(10) Patent No.: US 10,930,199 B2
(45) Date of Patent: Feb. 23, 2021

(54) DISPLAY DEVICE INCLUDING TIMING CONTROLLER AND SOURCE DRIVING CIRCUIT AND METHOD OF DRIVING THE SAME

(71) Applicant: Samsung Display Co., Ltd., Yongin-Si (KR)

(72) Inventor: Junyong Ahn, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 40 days.

(21) Appl. No.: 16/386,570

(22) Filed: Apr. 17, 2019

(65) Prior Publication Data

US 2020/0035144 A1 Jan. 30, 2020

(30) Foreign Application Priority Data

Jul. 25, 2018 (KR) ..... 10-2018-0086658

(51) Int. Cl.
*G09G 3/20* (2006.01)

(52) U.S. Cl.
CPC ..... *G09G 3/2092* (2013.01); *G09G 2310/08* (2013.01); *G09G 2330/02* (2013.01)

(58) Field of Classification Search
CPC . G09G 2370/08; G09G 5/006; G09G 2330/12
See application file for complete search history.

(56) References Cited

U.S. PATENT DOCUMENTS 9,836,109 B2 12/2017 Lee
9,953,599 B2 4/2018 Kim et al.
2010/0033453 A1* 2/2010 Park ..... G09G 3/3648 345/204
2011/0234574 A1* 9/2011 Tanaka ..... G09G 3/2096 345/211
2013/0113777 A1* 5/2013 Baek ..... G09G 3/20 345/212
2014/0320437 A1 10/2014 Kang
2016/0284313 A1* 9/2016 Lin ..... G09G 5/008
2016/0351129 A1 12/2016 Kim et al.
2018/0190218 A1* 7/2018 Jang ..... G09G 3/3611

FOREIGN PATENT DOCUMENTS

KR 1020140128146 A 11/2014
KR 1020150039533 A 4/2015
KR 1020160113855 A 10/2016
KR 1020160141232 A 12/2016
KR 1020170080232 A 7/2017

* cited by examiner

*Primary Examiner* — Yuzhen Shen
(74) *Attorney, Agent, or Firm* — Cantor Colburn LLP

(57) ABSTRACT

A display device includes a display panel including a plurality of pixels, a timing controller which receives an image signal and a control signal and outputs transmission data, and a plurality of source driving circuits, each providing a data signal to a corresponding pixel among the plurality of pixels in response to the transmission data. Each of the source driving circuits applies a state information signal corresponding to an operation state to the timing controller, and the timing controller determines the operation state of the source driving circuits based on the state information signal, compresses the image signal when a source driving circuit of the source driving circuits is in an abnormal state to generate the transmission data, and applies the transmission data to a source driving circuit of the source driving circuits in a normal state.

19 Claims, 9 Drawing Sheets

DISPLAY DEVICE INCLUDING TIMING CONTROLLER AND SOURCE DRIVING CIRCUIT AND METHOD OF DRIVING THE SAME

This application claims priority to Korean Patent Application No. 10-2018-0086658, filed on Jul. 25, 2018, and all the benefits accruing therefrom under 35 U.S.C. § 119, the content of which in its entirety is herein incorporated by reference.

BACKGROUND

1. Field

Exemplary embodiments of the invention relate to a display device and a method of driving the same. More particularly, exemplary embodiments of the invention relate to a display device including a plurality of source driving circuits and a method of driving the display device.

2. Description of the Related Art

In general, a display device includes a display panel to display an image and a driving circuit to drive the display panel. The display panel includes gate lines, data lines, and pixels. The driving circuit includes a source driver which outputs a data driving signal to the data lines, a gate driver which outputs a gate driving signal to the gate lines, and a timing controller which controls the source driver and the gate driver.

The display device applies a gate-on voltage to a gate electrode of a thin film transistor ("TFT") connected to a gate line of the pixel through which the image is displayed and applies a data voltage corresponding to the image to a source electrode of the TFT, thereby displaying the image.

The timing controller applies an image signal and a control signal to the source driver, and the source driver outputs a plurality of data driving signals to drive the data lines in response to the image signal and the control signal.

SUMMARY

As a size of a display panel increases, a source driver includes a plurality of source driving circuits. A timing controller stops its operation when sensing that at least one of the source driving circuits is in an abnormal state.

Exemplary embodiments of the invention provide a display device capable of displaying an image through a portion of a display panel even though at least one of source driving circuits is in an abnormal state.

Exemplary embodiments of the invention provide a method of driving the display device.

In an exemplary embodiment of the invention, a display device includes a display panel including a plurality of pixels, a timing controller which receives an image signal and a control signal and outputs transmission data, and a plurality of source driving circuits. Each of the plurality of source driving circuits provides a data signal to a corresponding pixel among the plurality of pixels in response to the transmission data. Each of the source driving circuits applies a state information signal corresponding to an operation state to the timing controller, and the timing controller determines the operation state of the source driving circuits based on the state information signal, compresses the image signal when a source driving circuit of the source driving circuits is in an abnormal state to generate the transmission data, and applies the transmission data to a source driving circuit of the plurality of source driving circuits in a normal state.

In an exemplary embodiment, each of the source driving circuits includes a restoration processor which receives the transmission data, restores a data signal and a clock signal included in the transmission data, and outputs a clock lock signal, a state signal output circuit which outputs the state information signal in response to the clock lock signal, and a data output circuit which applies the data signal to the plurality of pixels in response to the restored data signal and the restored clock signal.

In an exemplary embodiment, the state signal output circuit includes a resistor connected between a power source voltage and a first node and a switching transistor including a first electrode connected to the first node, a second electrode connected to a ground voltage, and a gate electrode which receives the clock lock signal.

In an exemplary embodiment, the timing controller includes an image signal processing circuit which converts the image signal to an internal image signal, a control signal generating circuit which converts the control signal to a first control signal, a transmitter which converts the internal image signal and the first control signal to the transmission data and applies the transmission data to the source driving circuits, and a receiver which receives the state information signal and outputs a mode signal which indicates a normal mode or a safe mode.

In an exemplary embodiment, the image signal processing circuit outputs the internal image signal obtained by compressing the image signal when the mode signal indicates the safe mode.

In an exemplary embodiment, the first control signal includes a data enable signal, and the control signal generating circuit outputs the data enable signal having a pulse width corresponding to the mode signal.

In an exemplary embodiment, the pulse width of the data enable signal is in proportion to a number of the source driving circuit of the source driving circuits in the normal state.

In an exemplary embodiment, the receiver outputs the state information signal corresponding to the normal mode when the state information signal is at a first level.

In an exemplary embodiment, the receiver outputs the mode signal including information regarding a source driving circuit that outputs the state information signal at a second level when the state information signal is at the second level.

In an exemplary embodiment, the image signal processing circuit determines a compression rate based on a number of the source driving circuits that outputs the state information signal at the second level when the mode signal indicates the safe mode, and the image signal processing circuit outputs a portion of the image signal corresponding to one frame as the internal image signal in accordance with the determined compression rate.

In an exemplary embodiment, the timing controller further includes a memory that stores a warning message signal corresponding to a warning message.

In an exemplary embodiment, the image signal processing circuit sequentially outputs the warning message signal stored in the memory and an image signal obtained by compressing the image signal as the internal image signal when the mode signal indicates the safe mode.

In an exemplary embodiment, the timing controller transmits a test pattern to the source driving circuits and receives the state information signal during an initialization period.

In an exemplary embodiment, the timing controller repeatedly transmits the test pattern to the source driving circuits when a source driving circuit of the source driving circuits is in the abnormal state based on the state information signal.

In an exemplary embodiment, the timing controller determines one of a normal mode or a safe mode as an operation mode based on the state information signal applied thereto after the test pattern is repeatedly transmitted to the source driving circuits, compresses the image signal to generate the transmission data for the safe mode, and provides the transmission data to the least one of the source driving circuits in the normal state.

According to exemplary embodiments, a method of driving a display device includes transmitting a test pattern to a plurality of source driving circuits, receiving a state information signal from each of the plurality of source driving circuits, determining whether a source driving circuit of the source driving circuits is in an abnormal state based on the state information signal, repeatedly transmitting the test pattern when the source driving circuit of the source driving circuits is in the abnormal state, determining one of a normal mode or a safe mode as an operation mode based on the state information signal applied thereto after the test pattern is repeatedly transmitted, compressing an image signal for the safe mode, and providing a compressed image signal as transmission data to a source driving circuit of the source driving circuits in a normal state.

In an exemplary embodiment, each of the plurality of source driving circuits includes a restoration processor receiving the transmission data, restoring a data signal and a clock signal included in the transmission data, and outputting a clock lock signal, and a state signal output circuit outputting the state information signal in response to the clock lock signal.

In an exemplary embodiment, the method further includes converting the image signal to an internal image signal for the normal mode, generating a data enable signal having a first pulse width, and transmitting the internal image signal and the data enable signal as the transmission data to the plurality of source driving circuits.

In an exemplary embodiment, the method further includes generating the data enable signal having a second pulse width smaller than the first pulse width for the safe mode and transmitting the compressed image signal and the data enable signal as the transmission data to the source driving circuit in the normal state.

In an exemplary embodiment, the second pulse width of the data enable signal is in proportion to a number of the source driving circuit in the normal state.

According to the above, the display device displays the image through the portion of the display panel even though at least one of the source driving circuits is in the abnormal state, and thus important or high priority information, such as information regarding the disaster occurrence and evacuation method, may be provided to the user under natural disaster or disaster situation.

BRIEF DESCRIPTION OF THE DRAWINGS

The above and other exemplary embodiments and features of the invention will become readily apparent by reference to the following detailed description when considered in conjunction with the accompanying drawings, in which.

DETAILED DESCRIPTION

Figure 1:
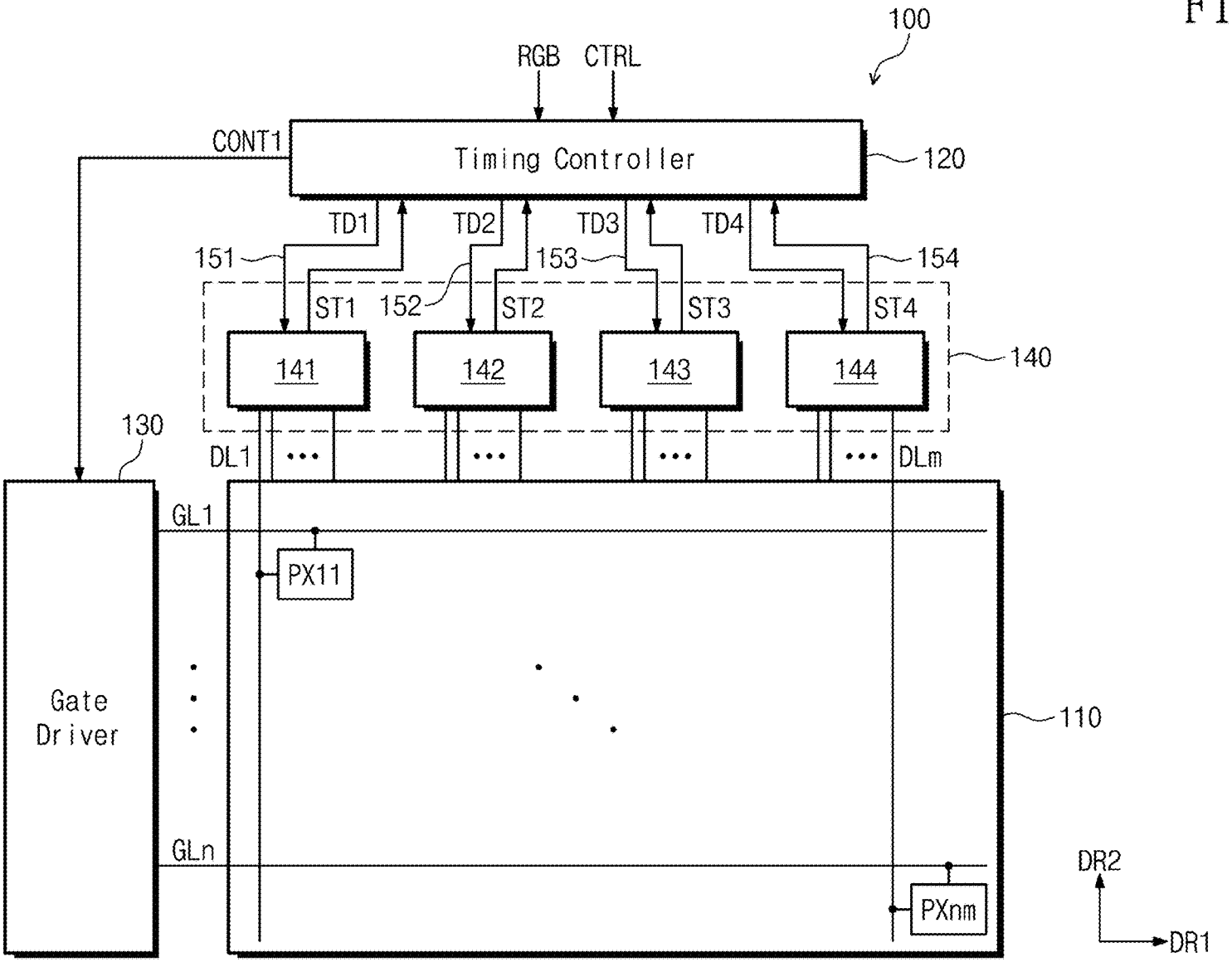
FIG. 1 is a block diagram showing an exemplary embodiment of a configuration of a display device according to the invention.

It will be understood that when an element or layer is referred to as being "on", "connected to" or "coupled to" another element or layer, it can be directly on, connected or coupled to the other element or layer or intervening elements or layers may be present.

Like numerals refer to like elements throughout. In the drawings, the thickness of layers, films, and regions are exaggerated for clarity.

As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be understood that when an element or layer is referred to as being "connected to" or "contact" another element or layer, it can be directly connected to or contact the other element or layer or intervening elements or layers may be present. In contrast, when an element is referred to as being "directly connected to" or "directly contact" another element or layer, there are no intervening elements or layers present. Other expressions used to describe the relationship between elements, such as, "between", "right between", "adjacent to", and "directly neighboring", are to be interpreted likewise.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Hereinafter, the invention will be explained in detail with reference to the accompanying drawings.

FIG. 1 is a block diagram showing a configuration of an exemplary embodiment of a display device 100 according to the invention.

Referring to FIG. 1, an exemplary embodiment of the display device 100 includes a display panel 110, a timing controller 120, a gate driver 130, and a source driver 140. The source driver 140 includes source driving circuits 141 to 144. In the illustrated exemplary embodiment, the source driver 140 includes four source driving circuits 141, 142, 143, and 144. However, the invention is not limited thereto, and the number of the source driving circuits should not be limited to four.

In an exemplary embodiment, the display panel 110 includes a plurality of data lines DL1 to DLm, a plurality of gate lines GL1 to GLn arranged to cross the data lines DL1 to DLm, and a plurality of pixels PX11 to PXnm arranged in areas defined by the data lines DL1 to DLm and the gate lines GL1 to GLn where n and m are natural numbers. The gate lines GL1 to GLn extend in a first direction DR1 from the gate driver 130 and are sequentially arranged in a second direction DR2. The data lines DL1 to DLm extend in the second direction DR2 from the source driver 140 and are sequentially arranged in the first direction DR1. The data lines DL1 to DLm are insulated from the gate lines GL1 to GLn.

In an exemplary embodiment, the timing controller 120 receives image signals RGB and control signals CTRL from an outside. The timing controller 120 applies a first control signal CONT1 to the gate driver 130 and transmits transmission data TD1 to TD4 serialized by a clock embedded interface manner to the source driving circuits 141 to 144 through signal lines 151 to 154, respectively. Each of the transmission data TD1 to TD4 may include image data signals and a clock signal. The timing controller 120 and the source driving circuits 141 to 144 are connected to each other through the signal lines 151 to 154 in a pin-to-pin manner, for example. In addition, the timing controller 120 and the source driving circuits 141 to 144 may transmit and receive signals through the signal lines 151 to 154 in a high-speed serial interface manner, for example. The interface manner between the timing controller 120 and the source driving circuits 141 to 144 is referred to as an intra-panel interface.

In an exemplary embodiment, the gate driver 130 drives the gate lines GL1 to GLn in response to the first control signal CONT1 from the timing controller 120. The gate driver 130 may be implemented in an independent integrated circuit ("IC") chip and may be electrically connected to one side portion of the display panel 110. In addition, the gate driver 130 may be implemented in a circuit with an amorphous silicon gate ("ASG") using an amorphous silicon thin film transistor ("a-Si TFT"), an oxide semiconductor, a crystalline semiconductor, a polycrystalline semiconductor, or the like and may be integrated in a predetermined area of the display panel 110, for example. In another exemplary embodiment, the gate driver 130 may be implemented in a tape carrier package ("TCP") or a chip-on-film ("COF"), for example.

Each of the source driving circuits 141 to 144 drives the data lines DL1 to DLm in response to the transmission data TD1 to TD4 provided from the timing controller 120.

Each of the source driving circuits 141 to 144 may be implemented in an IC and may be electrically connected to one side portion of the display panel 110 or directly disposed (e.g., mounted) on the display panel 110. Each of the source driving circuits 141 to 144 transmits state information signals ST1 to ST4 to the timing controller 120.

The timing controller 120 may determine an operation state of the source driving circuits 141 to 144 based on the state information signals ST1 to ST4 provided from the source driving circuits 141 to 144.

Switching transistors of the pixels arranged in the same one row and connected to one gate line are turned on while a gate-on voltage is applied to the one gate line. In this case, the source driving circuits 141 to 144 provide data driving signals corresponding to the image data signals included in the transmission data TD1 to TD4 to the data lines DL1 to DLm. The data driving signals provided to the data lines DL1 to DLm are applied to corresponding pixels through the turned-on switching transistors.

Figure 2:
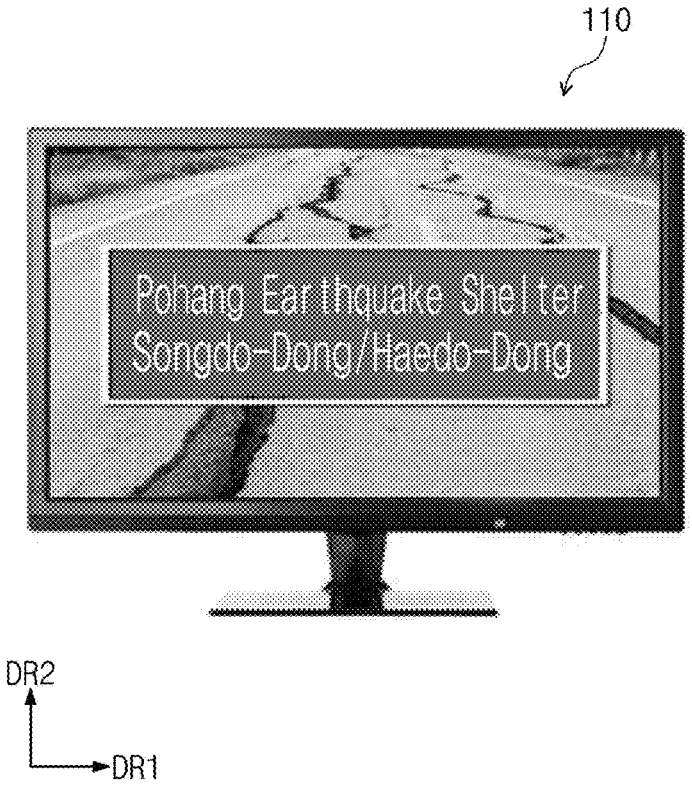
FIG. 2 is a view showing an image displayed through a display panel in a normal mode.

FIG. 2 is a view showing an image displayed through a display panel in a normal mode.

Referring to FIGS. 1 and 2, the timing controller 120 may determine that the source driving circuits 141 to 144 are in the normal state when the state information signals ST1 to ST4 provided from the source driving circuits 141 to 144 are at a first level (e.g., a high level). The display panel 110 may be operated in the normal mode in which the image is displayed through the whole area of the display panel 110 while the source driving circuits 141 to 144 are in the normal state.

The timing controller 120 may be operated in a safe mode when at least one state information signal of the state information signals ST1 to ST4 provided from the source driving circuits 141 to 144 is at a second level (e.g., a low level) rather than the first level (e.g., the high level). In the safe mode, the timing controller 120 may transmit the transmission data to the source driving circuit determined as the normal mode among the source driving circuits 141 to 144.

Figure 3:
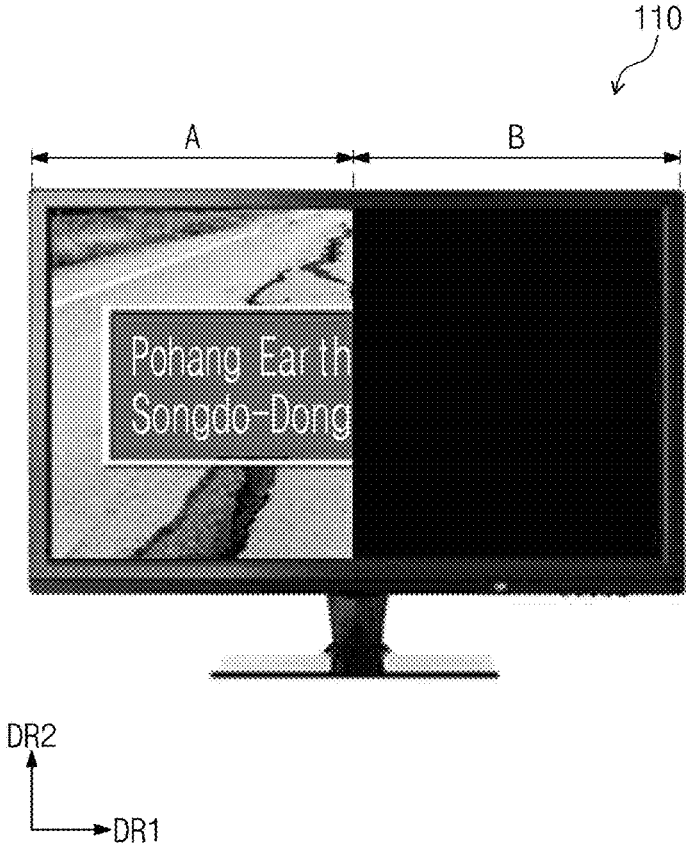
FIG. 3 is a view showing an image displayed through the display panel when some source driving circuits of source driving circuits are in an abnormal state.

FIG. 3 is a view showing an image displayed through the display panel 110 when some source driving circuits of the source driving circuits are in an abnormal state. Referring to FIGS. 1 and 3, the timing controller 120 determines the operation state of the source driving circuits 141 to 144 based on the state information signals ST1 to ST4 provided from the source driving circuits 141 to 144. As an example, when the source driving circuits 141 and 142 are in the normal state and the source driving circuits 143 and 144 are in the abnormal state among the source driving circuits 141 to 144, the timing controller 120 may transmit the transmission data TD1 and TD2 only to the source driving circuits 141 and 142.

In this case, the image is displayed in a first area "A" of the display panel 110 corresponding to the source driving circuits 141 and 142 in the normal state and is not displayed in a second area "B". In a case where some source driving circuits among the source driving circuits 141 to 144 are damaged in a natural disaster, such as an earthquake and a flood, or a disaster situation, such as a building collapse and a fire, the image is not displayed in some areas of the display panel 110, which correspond to the damaged source driving circuits, and thus important or high priority information may not be provided to a user. In the case where some source driving circuits among the source driving circuits 141 to 144 are damaged, the exemplary embodiment of the display device 100 according to the invention may provide high priority or important information, such as information regarding the disaster occurrence and evacuation method, to the user.

Figure 4:
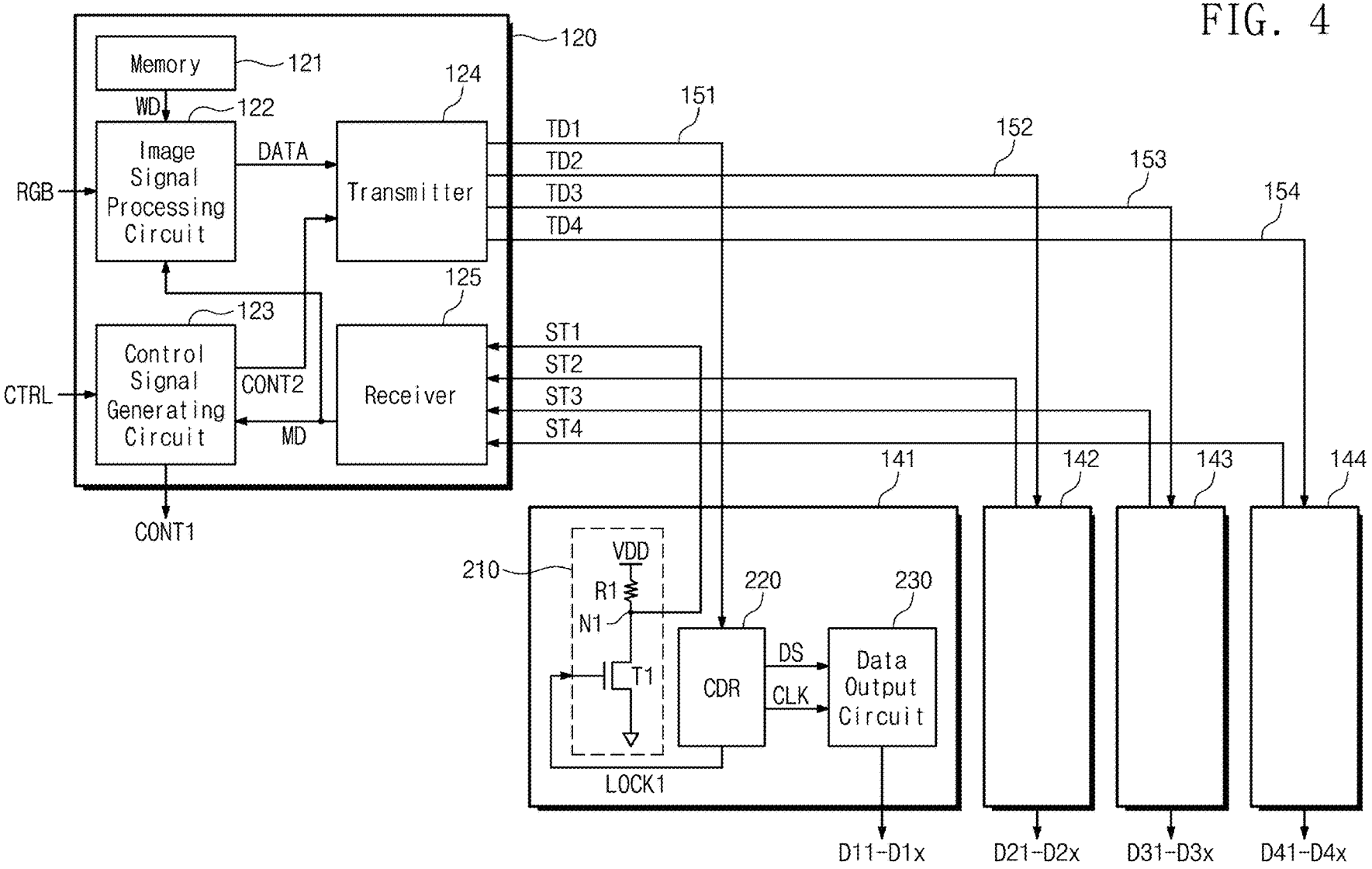
FIG. 4 is a block diagram showing an exemplary embodiment of a configuration of a timing controller and a source driver according to the invention.

FIG. 4 is a block diagram showing an exemplary embodiment of a configuration of the timing controller 120 and the source driver according to the invention.

Referring to FIG. 4, the timing controller 120 includes a memory 121, an image signal processing circuit 122, a control signal generating circuit 123, a transmitter 124, and a receiver 125. The memory 121 may store a warning message. The warning message stored in the memory 121 may include a message indicating the abnormal state of the display device 100, i.e., the message indicating that the display device 100 is operated in the safe mode.

The image signal processing circuit 122 converts the image signals RGB to internal image signals DATA. As an example, the image signal processing circuit 122 may perform an image signal conversion function, such as a gamma conversion with respect to the image signals RGB and a dynamic capacitance compensation, to improve a display quality. The internal image signals DATA output from image signal processing circuit 122 are provided to the transmitter 124.

The control signal generating circuit 123 outputs the first control signal CONT1 and a second control signal CONT2 based on the control signals CTRL provided from the outside. In an exemplary embodiment, the first control signal CONT1 may include a vertical synchronization start signal, an output enable signal, and a gate pulse signal, for example, and is provided to the gate driver 130 shown in FIG. 1. In an exemplary embodiment, the second control signal CONT2 may include a horizontal synchronization start signal and a clock signal, for example. The second control signal CONT2 is provided to the transmitter 124.

The transmitter 124 receives the internal image signals DATA and the second control signal CONT2 and transmits the transmission data TD1 to TD4 to the source driving circuits 141 to 144 through the signal lines 151 to 154 in the clock embedded interface manner, respectively.

In the illustrated exemplary embodiment, each of the source driving circuits 141 to 144 is connected to "x" number of data lines. In an exemplary embodiment, the source driving circuit 141 outputs data signals D11 to D1*x*, the source driving circuit 142 outputs data signals D21 to D2*x*, the source driving circuit 143 outputs data signals D31 to D3*x*, and the source driving circuit 144 outputs data signals D41 to D4*x*. The data signals D11 to D1*x*, D21 to D2*x*, D31 to D3*x*, and D41 to D4*x* may be provided to the data lines DL1 to DLm shown in FIG. 1, for example. However, the invention is not limited thereto, the number of the data lines connected to each of the 141 to 144 may be changed in various ways.

The receiver 125 receives the state information signals ST1 to ST4 feedback from the source driving circuits 141 to 144. The receiver 125 outputs a mode signal MD based on the state information signals ST1 to ST4. The mode signal MD may be a signal that indicates the normal or abnormal state of each of the source driving circuits 141 to 144. As an example, the mode signal MD may be a four-bit signal. When the mode signal MD has a binary value of '1111', the mode signal MD indicates the normal mode in which all of the source driving circuits 141 to 144 are in the normal state, and when the mode signal MD has a binary value of '0111', '1011', or '1100', the mode signal MD indicates the safe mode in which at least one of the source driving circuits 141 to 144 is in the abnormal state. However, the invention is not limited thereto, and in other exemplary embodiments, the mode signal MD may have various other binary values.

The image signal processing circuit 122 outputs the internal image signals DATA obtained by compressing the image signals RGB in response to the mode signal MD. A compression rate for the image signals RGB may be determined depending on the mode signal MD. The control signal generating circuit 123 outputs the second control signal CONT2 based on a data enable signal DE (refer to FIGS. 8 and 10) having a pulse width corresponding to the mode signal MD. Operations of the image signal processing circuit 122 and the control signal generating circuit 123 during the safe mode will be described in detail later.

The source driving circuit 141 includes a state signal output circuit 210, a restoration processor 220, and a data output circuit 230. FIG. 4 shows a circuit configuration of the source driving circuit 141 only. However, other source driving circuits 142 to 144 may have the same circuit configuration as the source driving circuit 141.

The restoration processor 220 receives the transmission data TD1 from the timing controller 120, restores an image data signal DS and a clock signal CLK included in the transmission data TD1, and outputs a clock lock signal LOCK1. The restoration processor 220 may be referred to as a clock data recovery ("CDR") circuit. The restoration processor 220 monitors whether the image data signal DS and the clock signal CLK are synchronized with each other, outputs the clock lock signal LOCK1 having the second level (e.g., the low level) when the image data signal DS and the clock signal CLK are synchronized with each other (lock), and outputs the clock lock signal LOCK1 having the first level (e.g., the high level) when the image data signal DS and the clock signal CLK are not synchronized with each other (unlock).

The state signal output circuit 210 outputs the state information signal ST1 in response to the clock lock signal LOCK1. The state signal output circuit 210 includes a resistor R1 and a switching transistor T1. The resistor R1 is connected between a power source voltage VDD and a first node N1. The switching transistor T1 includes a first electrode connected to the first node N1, a second electrode connected to a ground voltage, and a gate electrode receiving the clock lock signal LOCK1.

When the clock lock signal LOCK1 has the second level (e.g., the low level), the switching transistor T1 is turned off, and the state information signal ST1 of the first node N1 maintains the high level. When the clock lock signal LOCK1 has the first level (e.g., the high level), the switching transistor T1 is turned on, and the state information signal ST1 of the first node N1 is discharged to the low level.

When the source driving circuit 141 is damaged in various disaster situations, the restoration processor 220 may not precisely restore the image data signal DS and the clock signal CLK. In this case, since the clock lock signal LOCK1 having the first level (e.g., the high level) is output, the state information signal ST1 is discharged to the low level. In addition, when the source driving circuit 141 is in the abnormal state, the power source voltage VDD connected to the resistor R1 is blocked, and the state information signal ST1 becomes the low level.

As described above, when the restoration process with respect to the image data signal DS and the clock signal CLK is unstable in the restoration processor 220 of the source driving circuit 141 or the power source voltage VDD is unstable, the state information signal ST1 becomes the low level.

Although the state information signal ST1 has the low level, the receiver 125 of the timing controller 120 determines that the source driving circuit 141 is in the normal state when the state information signal ST1 is transited to the high level within a predetermined period of time. However, when the state information signal ST1 maintains the low level for more than a predetermined period of time, the receiver 125 of the timing controller 120 determines that the source driving circuit 141 is in the abnormal state and outputs the mode signal MD indicating the safe mode.

Figure 5:
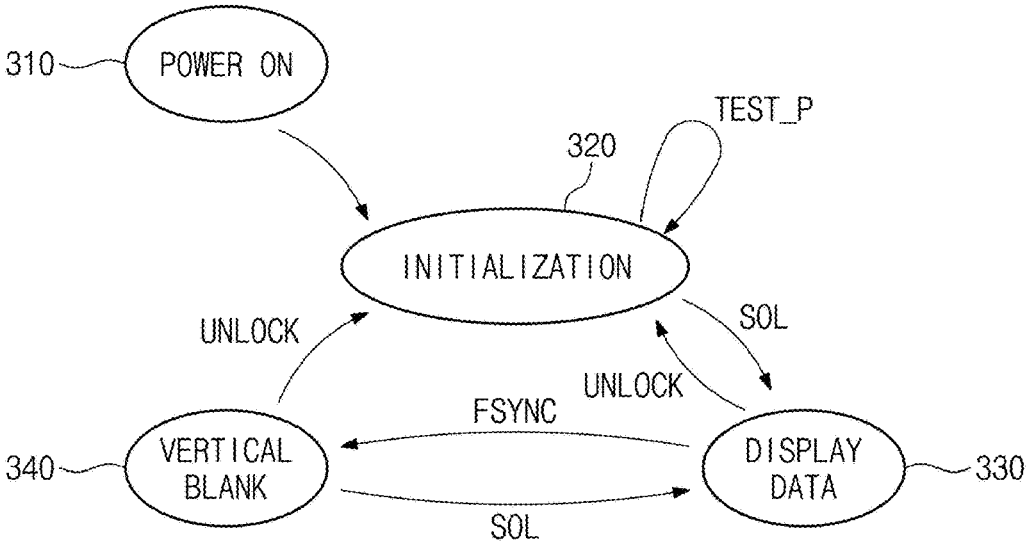
FIG. 5 is a state diagram showing an exemplary embodiment of operation modes of a display device according to the invention.

FIG. 5 is a state diagram showing an exemplary embodiment of operation modes of the display device according to the invention.

Referring to FIGS. 4 and 5, when the timing controller 120 is powered on (310), the timing controller 120 is operated in an initialization mode 320. The timing controller 120 may be operated in the initialization mode 320 during an initialization period. The initialization mode 320 may include an initial training mode and a test mode. The timing controller 120 may transmit a clock training signal to the source driving circuits 141 to 144 in the initial training mode to allow the restoration processor 220 to output the clock lock signal LOCK1. The timing controller 120 may repeatedly transmit a test pattern TEST_P to test the state of the source driving circuits 141 to 144 in the test mode.

When the source driving circuits 141 to 144 are stabilized and are in a standby state, the timing controller 120 is operated in a display data mode 330. The timing controller 120 transmits the transmission data TD including a line start field SOL to the source driving circuits 141 to 144 to indicate a start of the display data mode 330. The timing controller 120 may be operated in the display data mode 330 during a data transmission period. The timing controller 120 may transmit data respectively corresponding to lines of image frames to the source driving circuits 141 to 144 in the display data mode 330.

When the transmission data TD corresponding to one frame are transmitted, the timing controller 120 is operated in a vertical blank mode 340. The timing controller 120 transmits the transmission data TD including a frame synchronization signal FSYNC to the source driving circuit 141 to 144 to indicate an end of the display data mode 330. The timing controller 120 may be operated in a vertical training mode during the vertical blank mode 340. In the vertical training mode, the timing controller 120 may transmit a modulated clock signal. In addition, the timing controller 120 may be operated in the vertical training mode and the test mode during the vertical blank mode 340. That is, the vertical blank mode may include the vertical training mode and the test mode.

The display data mode 330 and the vertical blank mode 340 may be repeatedly performed every frame. The display data mode 330 and the vertical blank mode 340 may be repeatedly performed until the timing controller 120 is powered off or a soft fail occurs in the source driving circuits 141 to 144. When the vertical blank mode 340 is changed to the display data mode 330, the timing controller 120 may transmit the transmission data TD including the line start field SOL to the source driving circuits 141 to 144. When the display data mode 330 is changed to the vertical blank mode 340, the timing controller 120 may transmit the transmission data TD including the frame synchronization signal FSYNC to the source driving circuits 141 to 144.

When the soft fail, e.g., the unlock of the restoration processor 220, occurs in the source driving circuits 141 to 144 while the display data mode 330 or the vertical blank mode 340 is performed, the initialization mode 320 is performed again. In the initial training mode of the initialization mode 320, the timing controller 120 may transmit the clock training signal to the source driving circuits 141 to 144, and the restoration processor 220 may be locked based on the clock training signal. In the initial training mode of the initialization mode 320, the source driving circuits 141 to 144 may initialize setting values varied by the soft fail. In addition, in the test mode of the initialization mode 320, the timing controller 120 may repeatedly transmit the test pattern TEST_P to test each of the source driving circuits 141 to 144 and may test the standby state of the source driving circuits 141 to 144.

When the state information signal ST1 maintains the low level even when the test pattern TEST_P is repeatedly transmitted to the source driving circuits 141 to 144 for a predetermined period of time, the receiver 125 of the timing controller 120 determines that the source driving circuit 141 is in the abnormal state and outputs the mode signal MD indicating the safe mode.

Figure 6:
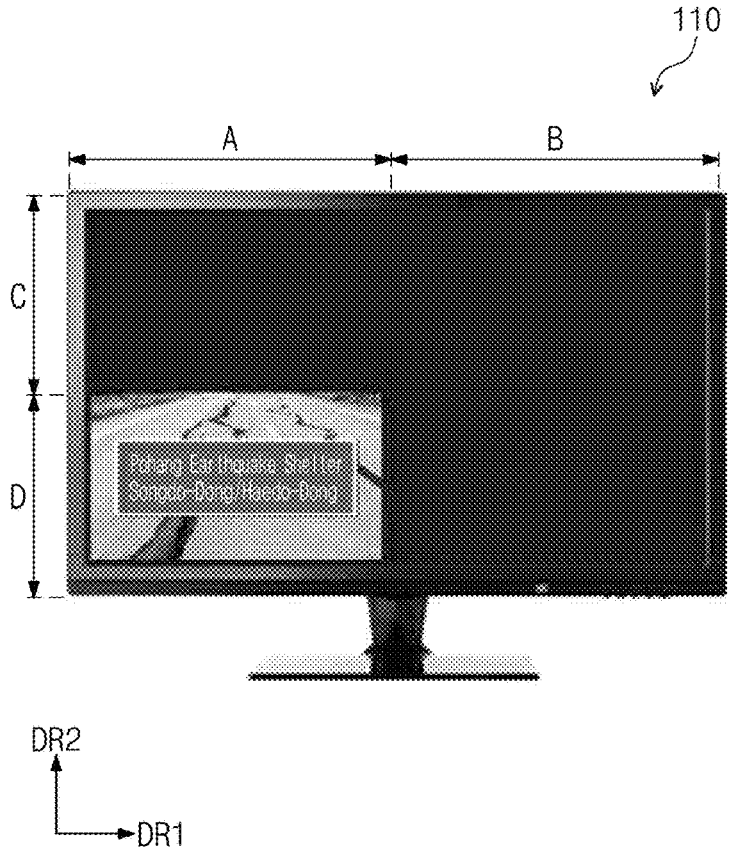
FIG. 6 is a view showing an exemplary embodiment of an image displayed through the display panel when a display device according to the invention is operated in a safe mode.

FIG. 6 is a view showing an exemplary embodiment of the image displayed through the display panel when the display device is operated in the safe mode according to the invention.

Referring to FIGS. 1 and 6, it is assumed that the state information signals ST1 and ST2 provided from the source driving circuits 141 and 142 among the source driving circuits 141 to 144 indicate the first level (e.g., the high level), i.e., the normal state, and the state information signals ST3 and ST4 provided from the source driving circuits 143 and 144 among the source driving circuits 141 to 144 indicate the second level (e.g., the low level), i.e., the abnormal state. In this case, the timing controller 120 is operated in the safe mode. The timing controller 120 is operated such that the image is displayed through an area A and D corresponding to the source driving circuits 141 and 142 of the display panel 110, i.e., an area defined by "A" in the first direction DR1 and "D" in the second direction DR2. In particular, the timing controller 120 is operated such that the image (refer to FIG. 2) displayed through the display panel 110 in the normal mode is displayed through the area A and D after being reduced. According to the operation, a resolution of the image displayed through the display panel 110 decreases. However, a loss in information or message desired to be transmitted to the user may be reduced.

Figure 7:
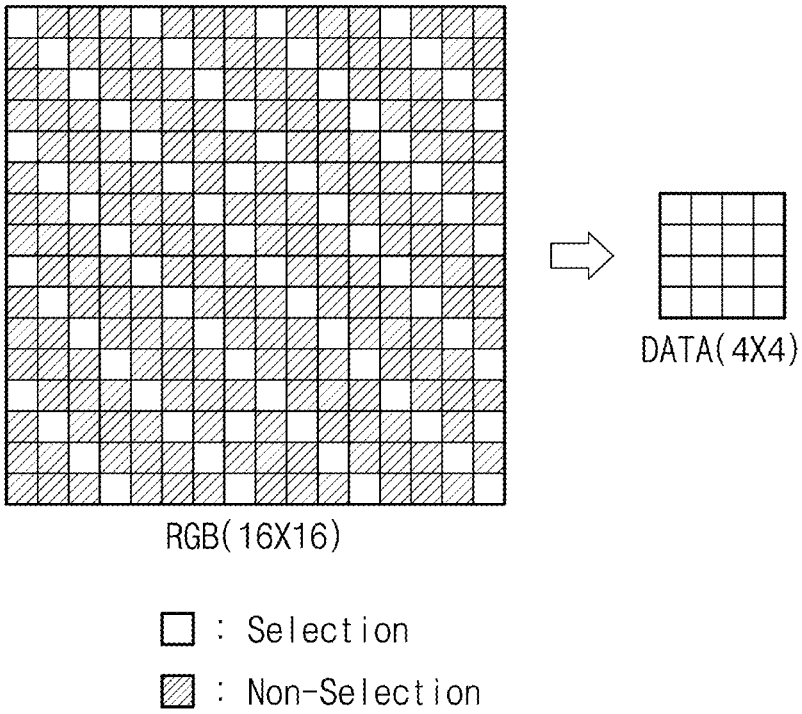
FIG. 7 is a view showing an exemplary embodiment of an image signal compressed by a timing controller according to the invention.

FIG. 7 is a view showing an exemplary embodiment of an image signal compressed by the timing controller according to the invention.

Referring to FIGS. 4 and 7, the image signal processing circuit 122 of the timing controller 120 may output the internal image signals DATA obtained by compressing the image signals RGB in response to the mode signal MD. The compression rate of the image signals RGB may be determined depending on the mode signal MD. In an exemplary embodiment, when it is assumed that the source driving circuits 141 and 142 are in the normal state and the source driving circuits 143 and 144 are in the abnormal state among the source driving circuits 141 to 144, the mode signal MD may have the binary value of '1100', for example. The timing controller 120 may output the internal image signals DATA obtained by compressing the image signals RGB at the compression rate of about 75% in response to the mode signal MD with the binary value of '1100', for example. However, the invention is not limited thereto, and in other exemplary embodiments, the image signals RGB may be compressed at the different compression rate.

In an exemplary embodiment, as shown in FIG. 7, the image signals RGB having a size of 16 by 16 (16×16) may be converted to the internal image signals DATA having a size of 4 by 4 (4×4), for example. The 16×16 blocks of FIG. 7 indicate the image signals RGB having a size corresponding to 16 pixels in the first direction DR1 and 16 pixels in the second direction DR2 of the display panel 110 shown in FIG. 1. Among the 16×16 blocks, white areas are selected as the internal image signals DATA, and hatched areas indicate the image signals RGB that are not selected. FIG. 7 shows a compression method that selects some of the image signals RGB and outputs the selected image signals as the internal image signals DATA. However, the compression method should not be limited thereto or thereby.

Figure 8:
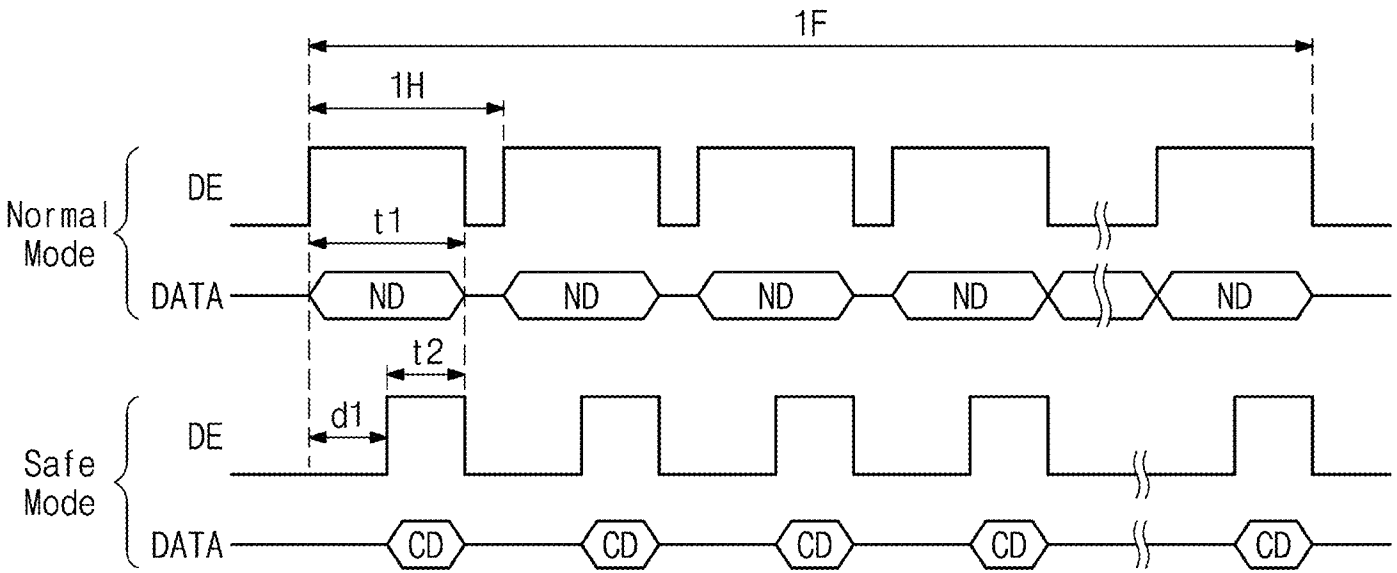
FIG. 8 is a timing diagram showing a data enable signal and an internal image signal in the normal mode and the safe mode.

FIG. 8 is a timing diagram showing the data enable signal and the internal image signals in the normal mode and the safe mode.

Referring to FIGS. 4 and 8, the control signal generating circuit 123 of the timing controller 120 receives external timing signals, such as a vertical synchronization signal, a horizontal synchronization signal, an external data enable signal, and a main clock, from an external host system (not shown) through an interface, e.g., a low voltage differential signaling ("LVDS") interface or a transition minimized differential signaling ("TMDS") interface, for example, and outputs the first control signal CONT1 and the second control signal CONT2. The control signal generating circuit 123 outputs the data enable signal DE that is an internal signal and represents one horizontal period 1H. The data enable signal DE may include pulses corresponding to the number of the gate lines GL1 to GLn (refer to FIG. 1) during one frame 1F.

The control signal generating circuit 123 outputs the data enable signal DE having a predetermined pulse width t1 for the normal mode. The image signal processing circuit 122 provides the internal image signals DATA including a normal data signal ND to the transmitter 124 for the normal mode.

The control signal generating circuit 123 outputs the data enable signal DE having a predetermined pulse width t2 for the safe mode. The pulse width t2 of the data enable signal DE in the safe mode may be smaller than the pulse width t1 of the data enable signal DE in the normal mode. The image signal processing circuit 122 provides the internal image signals DATA including a compressed data signal CD to the transmitter 124 for the safe mode.

In the exemplary embodiment of the invention, the pulse width t2 of the data enable signal DE is in proportion to the number of the source driving circuits in the normal state among the source driving circuits 141 to 144. As an example, in a case where the source driving circuits 141 to 143 are in the normal state and only the source driving circuit 144 is in the abnormal state among the source driving circuits 141 to 144, the pulse width of the data enable signal DE may be greater than the pulse width t2 shown in FIG. 8.

As shown in FIG. 6, in the case where the image is displayed in the area A and D of the display panel 110, the control signal generating circuit 123 outputs the data enable signal DE delayed for a predetermined time period d1. That is, the image is not displayed in an area A and C corresponding to the predetermined time period d1 of one frame 1F.

In another exemplary embodiment, in the case where the image is displayed in the area A and C of the display panel 110, the control signal generating circuit 123 outputs the data enable signal DE having the pulse width t2 without delaying. That is, the image is not displayed in the area A and D corresponding to the predetermined time period d1 of one frame 1F.

Figure 9:
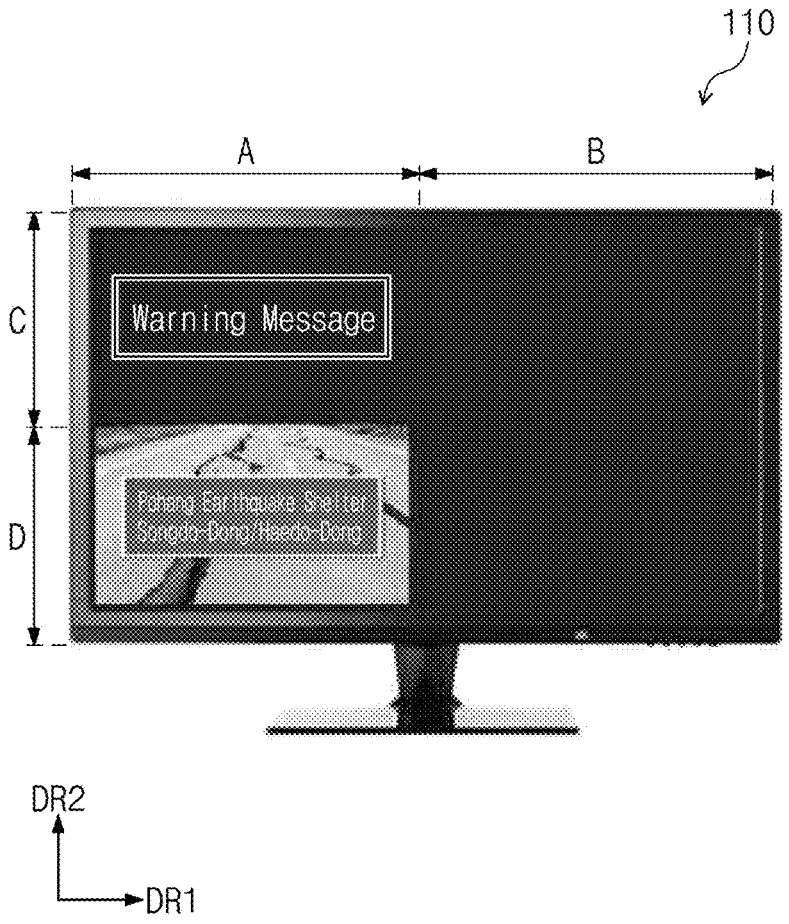
FIG. 9 is a view showing an exemplary embodiment of an image displayed through the display device according to the invention.

FIG. 9 is a view showing an exemplary embodiment of an image displayed through the display device according to the invention.

Referring to FIG. 9, a warning message indicating the safe mode may be displayed in the area A and C of the display panel 110, and the image corresponding to the image signals RGB provided from the external host system may be displayed in the area A and D. The message displayed in the area A and C of the display panel 110 is stored in the memory 121 shown in FIG. 4.

Figure 10:
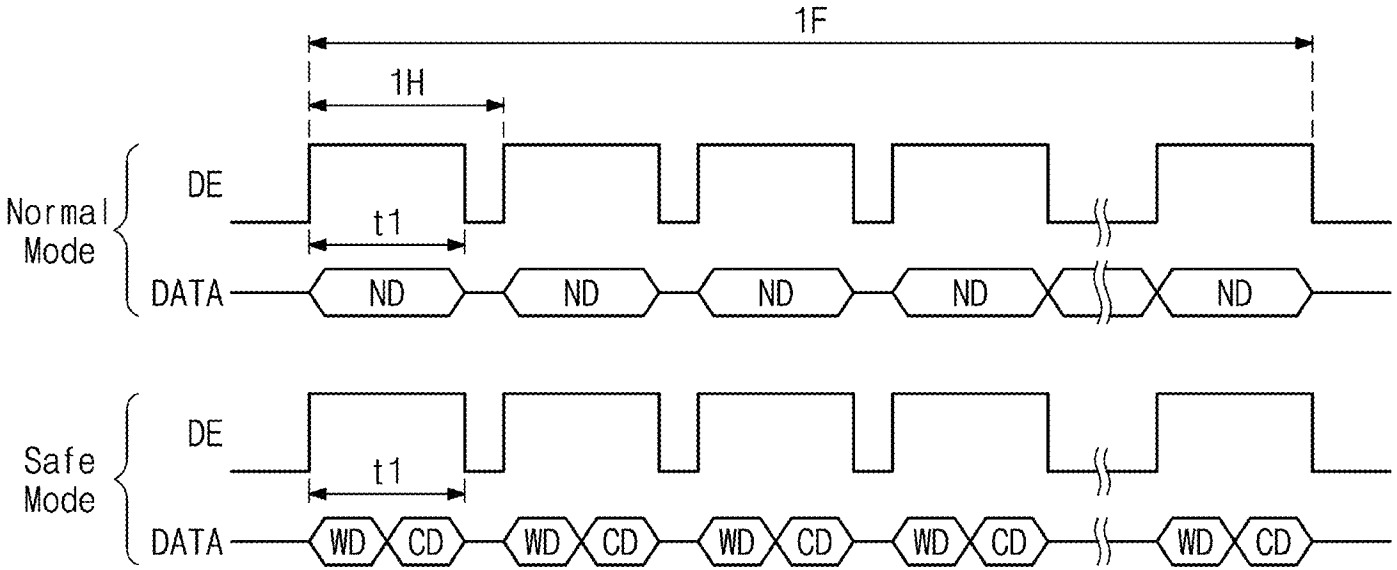
FIG. 10 is a timing diagram showing a data enable signal and an internal image signal in the normal mode and the safe mode.

FIG. 10 is a timing diagram showing the data enable signal and the internal image signals in the normal mode and the safe mode.

Referring to FIGS. 4 and 10, the control signal generating circuit 123 of the timing controller 120 outputs the data enable signal DE having the predetermined pulse width t1 for the normal mode. The image signal processing circuit 122 provides the internal image signals DATA including the normal data signal ND to the transmitter 124 for the normal mode.

The control signal generating circuit 123 outputs the data enable signal DE having the predetermined pulse width t1 for the safe mode. The pulse width t1 of the data enable signal DE in the safe mode is equal to the pulse width t1 of the data enable signal DE in the normal mode. The image signal processing circuit 122 sequentially outputs the warning message signal WD from the memory 121 and the compressed data signal CD as the internal image signals DATA for the safe mode.

Therefore, as shown in FIG. 9, an image corresponding to the warning message signal WD may be displayed in the area A and C of the display panel 110, an image signal corresponding to the compressed data signal CD may be displayed in the area A and D of the display panel 110.

As described above, the exemplary embodiment of the display device according to the invention displays the image through the portion of the display panel even though at least one of the source driving circuits among the source driving circuits is in the abnormal state, and thus important or high priority information, such as information regarding the disaster occurrence and evacuation method, may be provided to the user under natural disaster or disaster situation.

Figure 11:
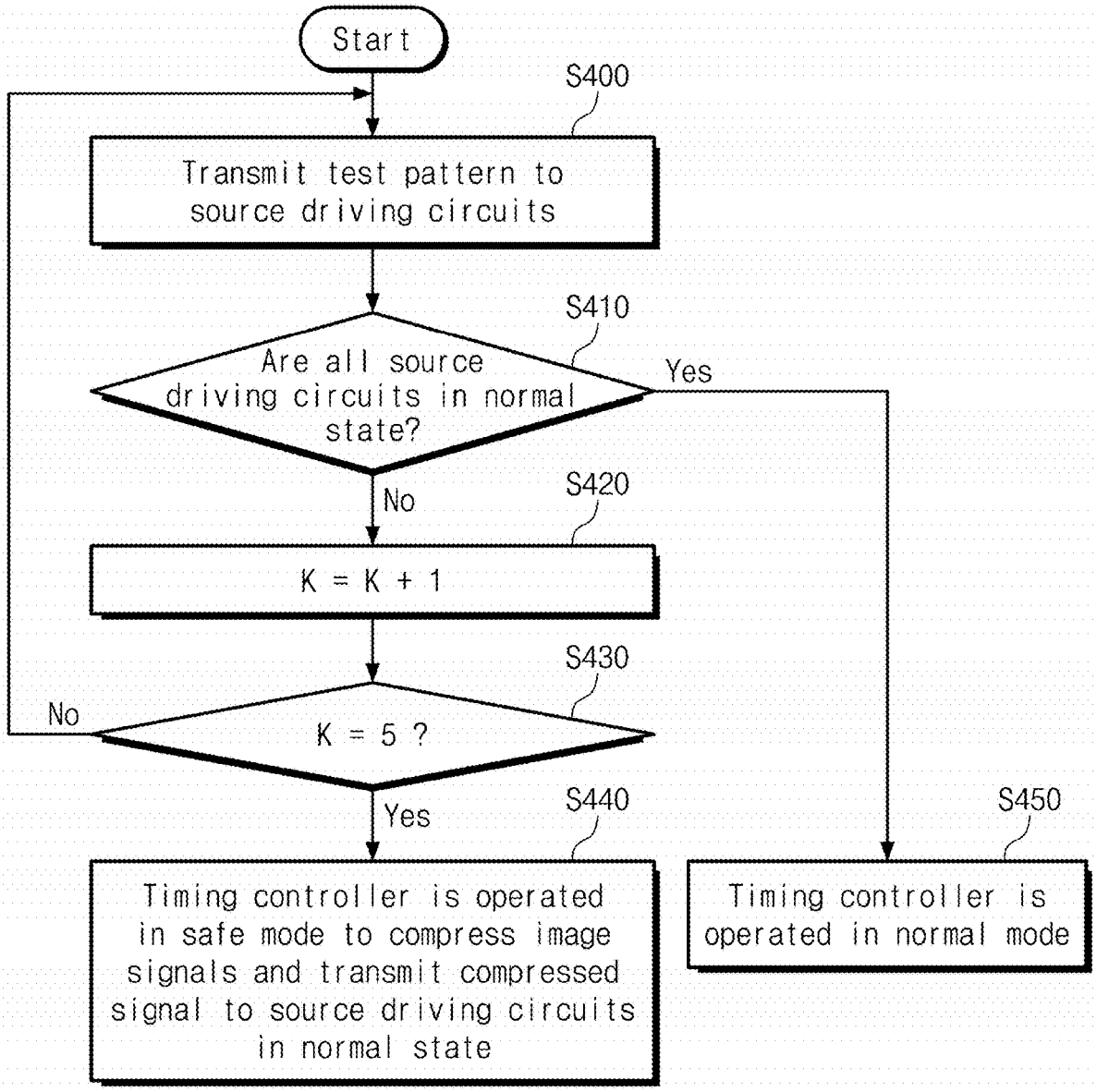
FIG. 11 is a flowchart illustrating an exemplary embodiment of a method of driving a display device according to the invention.

FIG. 11 is a flowchart illustrating an exemplary embodiment of a method of driving the display device according to the invention.

Referring to FIGS. 4 and 11, the timing controller 120 transmits the transmission data TD1 to TD4 including the test pattern TEST_P (refer to FIG. 5) to the source driving circuits 141 to 144 (S400). Each of the source driving circuits 141 to 144 receives the transmission data TD1 to TD4 and transmits the state information signals ST1 to ST4 to the timing controller 120. As described with reference to FIG. 5, the timing controller 120 may transmit the test pattern TEST_P to the source driving circuits 141 to 144 for the initialization mode 320.

The timing controller 120 determines whether all of the source driving circuits 141 to 144 are in the normal state based on the received state information signals ST1 to ST4 (S410).

When at least one of the source driving circuits 141 to 144 is in the abnormal state, the timing controller 120 increases a count value K by one (S420).

When the count value K does not reach a predetermined value (e.g., 5), the timing controller 120 returns to operation S400 to repeatedly perform the process of transmitting the test pattern TEST_P to the source driving circuits 141 to 144.

When it is determined that the at least one of the source driving circuits 141 to 144 is in the abnormal state and the count value K reaches the predetermined value (e.g., 5), the timing controller 120 is operated in the safe mode (S440). That is, the timing controller 120 generates the internal image signals DATA obtained by compressing the image signals RGB and the data enable signal DE having the predetermined pulse width. In the illustrated exemplary embodiment, the pulse width of the data enable signal DE may be in proportion to the number of the source driving circuits in the normal state among the source driving circuits 141 to 144. The timing controller 120 transmits the transmission data to the source driving circuits in the normal state among the source driving circuits 141 to 144. As an example, when only the source driving circuits 141 and 142 among the source driving circuits 141 to 144 are in the normal state, the transmission data TD1 and TD2 are transmitted to the source driving circuits 141 and 142.

When it is determined that all of the source driving circuits 141 to 144 are in the normal state before the count value K reaches the predetermined value (e.g., 5), the timing controller 120 is operated in the normal mode (S450).

The timing controller 120 converts the image signals RGB to the internal image signals DATA for the normal mode and generates the data enable signal DE having the predetermined pulse width. The timing controller 120 transmits the internal image signals DATA and the data enable signal DE to the source driving circuits 141 to 144 as the transmission data TD1 to TD4.

Although the exemplary embodiments of the invention have been described, it is understood that the invention should not be limited to these exemplary embodiments but various changes and modifications may be made by one ordinary skilled in the art within the spirit and scope of the invention as hereinafter claimed.

What is claimed is:

1. A display device comprising:

a display panel comprising a plurality of pixels;

a timing controller which receives an image signal and a control signal and outputs transmission data; and a plurality of source driving circuits, each of which provides a data signal to a corresponding pixel among the plurality of pixels in response to the transmission data, wherein each of the source driving circuits applies a state information signal corresponding to an operation state to the timing controller, and the timing controller determines the operation state of the source driving circuits based on the state information signal, compresses the image signal when a source driving circuit of the source driving circuits is in an abnormal state to generate the transmission data, and applies the transmission data to a source driving circuit of the source driving circuits in a normal state, wherein the timing controller comprises a control signal generating circuit which converts the control signal to a first control signal;

wherein the first control signal comprises a data enable signal, and the control signal generating circuit outputs the data enable signal having a pulse width which is controlled according to the operation state of the source driving circuits.

2. The display device of claim 1, wherein each of the source driving circuits comprises:

a restoration processor which receives the transmission data, restores the data signal and a clock signal included in the transmission data, and outputs a clock lock signal;

a state signal output circuit which outputs the state information signal in response to the clock lock signal; and a data output circuit which applies the data signal to the plurality of pixels in response to the restored data signal and the restored clock signal.

3. The display device of claim 2, wherein the state signal output circuit comprises:

a resistor connected between a power source voltage and a first node; and a switching transistor comprising a first electrode connected to the first node, a second electrode connected to a ground voltage, and a gate electrode which receives the clock lock signal.

4. The display device of claim 1, wherein the timing controller comprises:

an image signal processing circuit which converts the image signal to an internal image signal;

a transmitter which converts the internal image signal and the first control signal to the transmission data and applies the transmission data to the source driving circuits; and a receiver which receives the state information signal and outputs a mode signal indicating a normal mode or a safe mode.

5. The display device of claim 4, wherein the image signal processing circuit outputs the internal image signal obtained by compressing the image signal when the mode signal indicates the safe mode.

6. The display device of claim 4, wherein the receiver outputs the mode signal corresponding to the normal mode when the state information signal is at a first level.

7. The display device of claim 4, wherein the receiver outputs the mode signal comprising information regarding a source driving circuit which outputs the state information signal at a second level when the state information signal is at the second level.

8. The display device of claim 7, wherein the image signal processing circuit determines a compression rate based on a number of the source driving circuits which outputs the state information signal at the second level when the mode signal indicates the safe mode, and the image signal processing circuit outputs a portion of the image signal corresponding to one frame as the internal image signal in accordance with the determined compression rate.

9. The display device of claim 4, wherein the timing controller further comprises a memory which stores a warning message signal corresponding to a warning message.

10. The display device of claim 9, wherein the image signal processing circuit sequentially outputs the warning message signal stored in the memory and an image signal obtained by compressing the image signal as the internal image signal when the mode signal indicates the safe mode.

11. The display device of claim 1, wherein the pulse width of the data enable signal is in proportion to a number of the source driving circuit in the normal state.

12. The display device of claim 1, wherein the timing controller transmits a test pattern to the source driving circuits and receives the state information signal during an initialization period.

13. The display device of claim 12, wherein the timing controller repeatedly transmits the test pattern to the source driving circuits when the source driving circuit of the source driving circuits is in the abnormal state based on the state information signal.

14. The display device of claim 13, wherein the timing controller determines one of a normal mode or a safe mode as an operation mode based on the state information signal applied thereto after the test pattern is repeatedly transmitted to the source driving circuits, compresses the image signal to generate the transmission data for the safe mode, and provides the transmission data to the source driving circuit of the source driving circuits in the normal state.

15. A method of driving a display device, the method comprising:

transmitting a test pattern to a plurality of source driving circuits;

receiving a state information signal from each of the plurality of source driving circuits;

determining whether a source driving circuit of the plurality of source driving circuits is in an abnormal state based on the state information signal;

repeatedly transmitting the test pattern when the source driving circuit of the plurality of source driving circuits is in the abnormal state;

determining one of a normal mode or a safe mode as an operation mode based on the state information signal applied thereto after the test pattern is repeatedly transmitted;

compressing an image signal for the safe mode;

providing a compressed image signal as transmission data to a source driving circuit of the plurality of source driving circuits in a normal state, generating a data enable signal having a first pulse width for the normal mode;

generating the data enable signal having a second pulse width only smaller than the first pulse width for the safe mode.

16. The method of claim 15, wherein each of the plurality of source driving circuits comprises:

a restoration processor receiving the transmission data, restoring a data signal and a clock signal included in the transmission data, and outputting a clock lock signal; and a state signal output circuit outputting the state information signal in response to the clock lock signal.

17. The method of claim 15, further comprising:

converting the image signal to an internal image signal for the normal mode; and transmitting the internal image signal and the data enable signal as the transmission data to the plurality of source driving circuits.

18. The method of claim 17, further comprising:

transmitting the compressed image signal and the data enable signal as the transmission data to the source driving circuit in the normal state.

19. The method of claim 18, wherein the second pulse width of the data enable signal is in proportion to a number of the source driving circuit in the normal state.

* * * * *